US006682004B2

(12) United States Patent
Kadlubowski et al.

(10) Patent No.: US 6,682,004 B2
(45) **Date of Patent: *Jan. 27, 2004**

(54) ELECTROSTATIC SPRAY DEVICE

(75) Inventors: Bryan Michael Kadlubowski, Manchester, MD (US); David Edward Wilson, Reisterstown, MD (US); Jeffrey Keith Leppla, Baltimore, MD (US); Wataru Hirose, Kyoto (JP); Yoshihiro Wakiyama, Uji (JP); Takeshi Aoyama, Uji (JP); Takeshi Mori, Uji (JP); Yoshito Komada, Yamatokooriyama (JP); Toru Sumiyoshi, Ashiya (JP); Joseph Michael Crowley, Morgan Hill, CA (US)

(73) Assignee: The Procter & Gamble Company, Cincinnati, OH (US)

( * ) Notice: Subject to any disclaimer, the term of this patent is extended or adjusted under 35 U.S.C. 154(b) by 18 days.

This patent is subject to a terminal disclaimer.

(21) Appl. No.: 09/759,550

(22) Filed: Jan. 12, 2001

(65) Prior Publication Data

US 2001/0020652 A1 Sep. 13, 2001

Related U.S. Application Data

(63) Continuation-in-part of application No. 09/377,333, filed on Aug. 18, 1999, and a continuation-in-part of application No. 09/377,332, filed on Aug. 18, 1999.

(51) Int. Cl.[7] ..... B05B 5/00

(52) U.S. Cl. ..... 239/690; 239/690.1; 239/691; 239/692; 239/708; 239/332

(58) Field of Search ..... 239/690, 690.1, 239/691, 692, 704, 706, 708, 319, 320, 324, 329, 331, 332

(56) References Cited

U.S. PATENT DOCUMENTS

| | | | | |
|---|---|---|---|---|
| 2,159,894 A | | 5/1939 | Hines | 299/89 |
| 2,629,516 A | | 2/1953 | Badham | 222/79 |
| 3,012,969 A | | 12/1961 | van der Minne et al. | 252/153 |
| 4,000,443 A | | 12/1976 | Lever | |
| 4,079,894 A | | 3/1978 | Harjar et al. | 239/526 |
| 4,095,962 A | * | 6/1978 | Richards | 239/696 |
| 4,122,845 A | | 10/1978 | Stouffer et al. | 128/66 |
| 4,143,819 A | | 3/1979 | Hastings | 239/707 |
| 4,194,696 A | | 3/1980 | Harjar | 239/707 |
| 4,258,073 A | | 3/1981 | Payne | 427/1 |
| 4,331,298 A | | 5/1982 | Bentley et al. | |
| 4,549,243 A | * | 10/1985 | Owen et al. | 239/690 |
| 4,561,037 A | | 12/1985 | MacLaine et al. | 361/228 |

(List continued on next page.)

FOREIGN PATENT DOCUMENTS

| | | | |
|---|---|---|---|
| BE | 868443 | 12/1978 | |
| BE | 882449 | 7/1980 | |
| BE | 882450 | 7/1980 | |
| EP | 0 057 324 A | 8/1982 | |
| EP | 096 731 A1 | 12/1983 | A61N/1/04 |
| EP | 523 960 A1 | 1/1993 | B05D/1/04 |
| EP | 523 961 A1 | 1/1993 | B05D/1/04 |

(List continued on next page.)

*Primary Examiner*—Robin O. Evans
(74) *Attorney, Agent, or Firm*—Jack L. Oney; Dara M. Kendall

(57) ABSTRACT

The present invention is an electrostatic spraying device to electrostatically charge and dispense a product from a reservoir to a point of dispersal that includes a nozzle having an exit orifice and being disposed at the point of dispersal to disperse the product. A channel is included that permits the electrostatic charging of product. A positive displacement mechanism is used to move the product from the reservoir to the nozzle. A power source supplies an electrical charge. A portion of a high voltage electrode being disposed between the reservoir and the nozzle is used to electrostatically charge product within the channel at a charging location. A distance between the charging location and the nozzle exit orifice is governed by $V_o/d<100{,}000$, wherein $V_o$=an output voltage of said high voltage power supply and d=linear distance between the charging location and said nozzle exit orifice.

9 Claims, 8 Drawing Sheets

U.S. PATENT DOCUMENTS

| | | | | | |
|---|---|---|---|---|---|
| 4,577,803 | A | | 3/1986 | Owen | 239/690 |
| 4,907,727 | A | | 3/1990 | Ernst et al. | 222/386.5 |
| 4,971,257 | A | * | 11/1990 | Birge | 239/708 |
| 5,105,984 | A | | 4/1992 | Kazimir | 222/103 |
| 5,221,050 | A | | 6/1993 | Jeffries et al. | 239/708 |
| 5,222,663 | A | | 6/1993 | Noakes et al. | 239/3 |
| 5,229,105 | A | | 7/1993 | Wilmsmann | 424/59 |
| 5,268,166 | A | | 12/1993 | Barnett et al. | 424/47 |
| 5,292,067 | A | | 3/1994 | Jeffries et al. | 239/3 |
| 5,296,681 | A | | 3/1994 | Tschauder | 219/410 |
| 5,322,684 | A | | 6/1994 | Barnett et al. | 424/47 |
| 5,405,090 | A | | 4/1995 | Greene et al. | 239/708 |
| 5,422,630 | A | | 6/1995 | Quinn et al. | 340/661 |
| 5,468,488 | A | | 11/1995 | Wahi | 424/78.03 |
| 5,490,633 | A | | 2/1996 | Jeffries et al. | 239/691 |
| 5,494,674 | A | | 2/1996 | Barnett et al. | 424/401 |
| 5,519,159 | A | | 5/1996 | Narabe et al. | 558/169 |
| 5,531,384 | A | | 7/1996 | Greene et al. | |
| 5,662,890 | A | | 9/1997 | Punto et al. | 424/59 |
| 5,674,481 | A | | 10/1997 | Wahi | 424/78.03 |
| 5,732,884 | A | | 3/1998 | Jauner | 239/288.3 |
| 6,311,903 | B1 | * | 11/2001 | Gaw et al. | 239/690 |
| 6,318,647 | B1 | * | 11/2001 | Gaw et al. | 239/690 |

FOREIGN PATENT DOCUMENTS

| | | | | |
|---|---|---|---|---|
| EP | 523 962 | A1 | 1/1993 | B05D/1/04 |
| EP | 523 963 | A1 | 1/1993 | B05D/1/04 |
| EP | 523 964 | A1 | 1/1993 | B05D/1/04 |
| EP | 544 158 | | 6/1993 | C08F/26/06 |
| FR | 2127433 | | 9/1972 | |
| GB | 2 128 900 | A | 5/1984 | B05B/5/06 |
| GB | 2 273 673 | A | 6/1994 | B05B/5/025 |
| GB | 2 273 872 | A | 7/1994 | B05B/5/025 |
| JP | 10-146216 | | 6/1998 | A45D/33/38 |
| SU | 867927 | | 9/1981 | C14B/1/54 |
| WO | 94/11119 | | 5/1994 | B05D/1/04 |
| WO | 94/27560 | | 12/1994 | A61K/7/02 |
| WO | 95/29758 | | 11/1995 | B05B/5/025 |
| WO | 96/10459 | | 4/1996 | B05B/5/057 |
| WO | 96/11062 | | 4/1996 | B05B/5/053 |
| WO | 96/40441 | | 12/1996 | B05B/5/025 |
| WO | 97/33527 | | 9/1997 | A61B/19/00 |
| WO | 98/18561 | | 5/1998 | B05B/5/025 |

* cited by examiner

ELECTROSTATIC SPRAY DEVICE

CROSS-REFERENCE TO RELATED APPLICATION

This application is a continuation-in-part of our earlier applications, U.S. Ser. No. 09/377,332, filed on Aug. 18, 1999 and U.S. Ser. No. 09/377,333, filed on Aug. 18, 1999.

TECHNICAL FIELD OF INVENTION

This invention relates to a portable electrostatic spray device designed for personal use. More particular, this invention is focused on providing improvements to both the electronic circuit and mechanical designs which lead to the reduction/elimination of shock potentials, thereby improving the safety of the device for the user.

BACKGROUND OF THE INVENTION

In U.S. Pat. No. 4,549,243, Owen describes a spraying apparatus that can be held in the human hand for applications such as graphic work where it is desired that the area to which the spray is applied can be precisely controlled (Col 1, 11 5–9). Owen acknowledges both the benefits and hazards associated with stored capacitance when he describes that the high voltage circuit has sufficient capacitance that, during use, the desired electrical gradient at the nozzle is maintained between pulses but on the other hand should have a low stored energy, preferably less 10 mJ, so that no safety hazard is presented to the user for example by accidental contact of the user with the nozzle or on contact of the nozzle with an earthed surface (Col 5, 11 52–59). Owen further describes the occurrence of spark discharges and offers a solution to reduce such discharges, ". . . when a nozzle with a high potential applied thereto is brought close to an earthed surface, spark discharges from the nozzle to the earthed surface may occur instead of spraying; it is preferred that the field strength at the nozzle is such that the maximum distance of the nozzle from an earthed surface at which spark discharges occur is less than 5 mm" (Col 6, 11 14–20). Although recognizing the dangers associated with stored capacitance within the device, Owen fails to offer a means of dissipating said capacitance and chooses to try to design around it. The approach of designing around the internal capacitance, limiting to 10 mJ or less, limits the size/quantity of capacitors within the circuitry which in turn limits the ability to hold the output high voltage at a steady value. Further, Owen's electrical gradient design of limiting the distance at which a spark discharge will occur is not a consumer viable solution as it is very likely that a consumer will come in direct contact with the nozzle area (i.e. less than the 5 mm distance) either while the device is in operation or shortly thereafter before stored charge has been dissipated from the device.

In U.S. Pat. No. 5,222,664, Noakes provides an electrostatic spraying device with the added benefit of a shock suppression by means of high voltage circuitry having a bi-polar output with a frequency no greater than 10 Hz. The system described by Noakes uses an alternating polarity power supply for generation of a high voltage potential. Noakes recognizes for example, where a direct current electrostatic spraying device which is wholly hand held is used (and hence where no other path to ground exists other than through the operator), and if the operator is or becomes substantially isolated from ground (for instance, as a result of standing on a synthetic fiber carpet or wearing shoes having soles of insulating material), during spraying, charge will accumulate on the operator and, if the operator subsequently touches a grounded conductor, he/she will experience an electrical shock (Col 1, 11 46–56). Owen offers a solution for such problem by thus appropriate selection of the frequency (of the high voltage power supply switching between opposite polarities), it is possible to eliminate the sensation of electrical shock by the operator or at least reduce the sensation to a level at which the risk of an accident as a result of an involuntary reaction by the operator is reduced (Col 2, 11 26–30). However, the solution that Noakes sets forth as a means to reduce the potential for the user to build-up a charge and subsequently discharge this charge in the form of a shock is to provide specifications for the switching frequency of the alternating polarity power supply. While this may represent a viable solution for some cases, this does not find application in electrostatic spraying devices that generate high voltage power using a rectifier which use a single polarity output.

In U.S. Pat. No. 5,337,963, Noakes provides for an electrostatic spray device for the spraying of liquids and is particularly concerned with devices for spraying liquids into the surroundings. One aspect of the device set forth by Noakes is that when the cartridge is in place in the compartment and is connected to the high voltage output of the generator, the fact that the voltage is applied through the liquid column in the narrow bore of the tube will provide a high resistance path (and hence suppression of shock that would otherwise be experienced by touching the tip of the tube) by virtue of the resistivity of the liquid and the cross-section and length dimensions of the tube bore (Col 10, 11 22–30). This design, while offering some means of shock suppression, is not a consumer viable system in that it ignores the scenario where the column of liquid between the charging location and the discharge point is no longer filled with product, and therefore no longer offering a resistive path. This is the likely scenario where a user would receive a shock from such a device.

SUMMARY OF THE INVENTION

An electrostatic spraying device which is configured and disposed to electrostatically charge and dispense a product from a supply to a point of dispersal. The electrostatic spraying device has a reservoir configured to contain the supply of product and a nozzle to disperse the product. The nozzle being disposed at the point of dispersal. The nozzle has an exit orifice. A channel is disposed between the reservoir and the nozzle, wherein the channel permits the electrostatic charging of the product upon the product moving within the channel. A positive displacement mechanism is used to move the product from the reservoir to the nozzle. A power source supplies an electrical charge. A high voltage power supply, high voltage contact, and high voltage electrode are used. A portion of the high voltage electrode being disposed between the reservoir and the nozzle is used to electrostatically charge the product within the channel at a charging location. A distance between the charging location and the nozzle exit orifice is governed by the following relationship: $V_o/d<100{,}000$, wherein $V_o$=an output voltage of said high voltage power supply and d=linear distance between the charging location and said nozzle exit orifice. A moveable electrode cover may be used to substantially conceal the high voltage contact when the disposable cartridge is removed from the device. The high voltage contact may recess when the disposable cartridge is removed from the device or resurface when the disposable cartidge is inserted into the device.

BRIEF DESCRIPTION OF THE DRAWINGS

While the specification concludes with claims particularly pointing out and distinctly claiming the present invention it is believed that the same will be better understood from the following description, taken in conjunction with the accompanying drawings, in which:

DETAILED DESCRIPTION OF THE PREFERRED EMBODIMENTS

Figure 1:
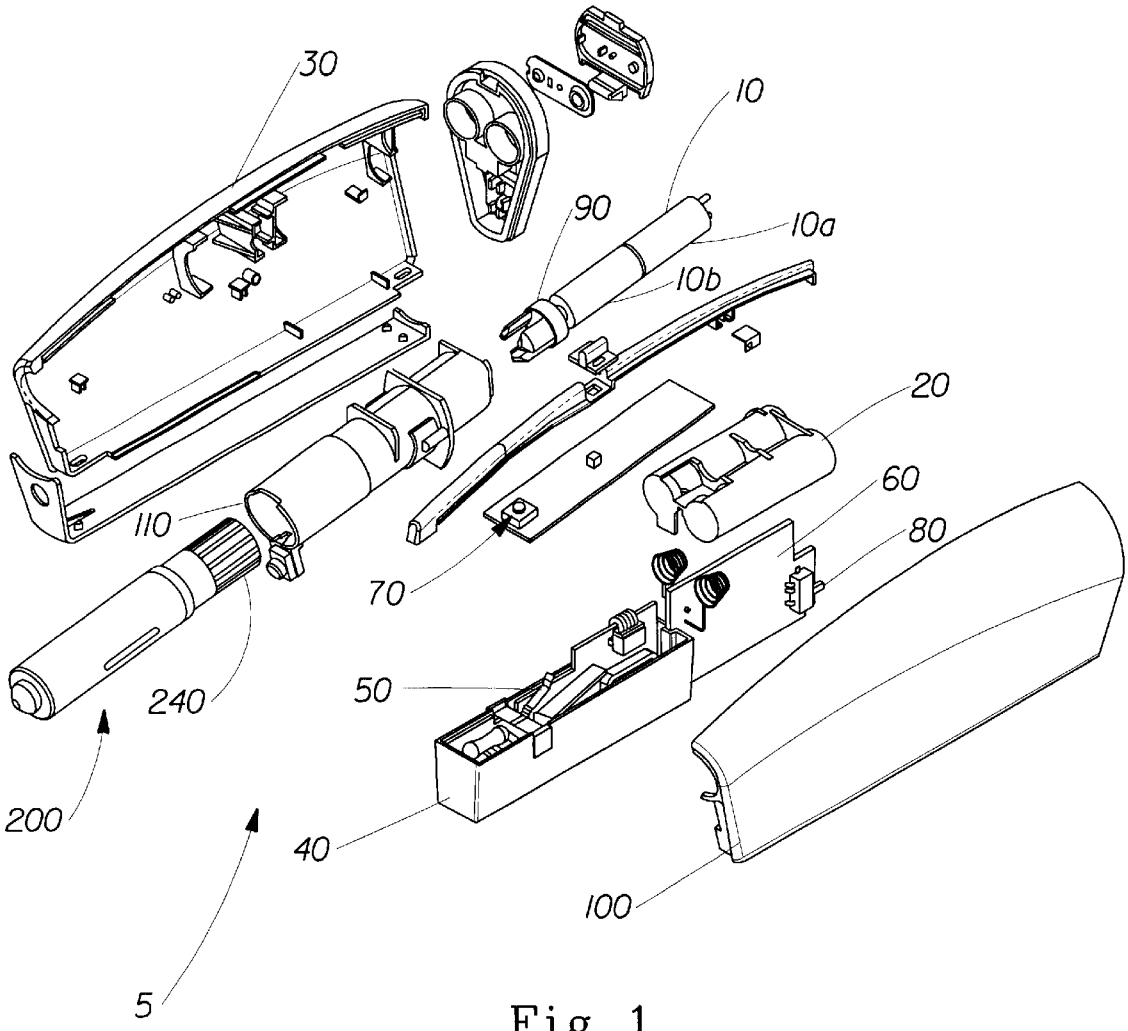
FIG. 1 is an exploded isometric view of a hand-held, self-contained electrostatic spraying device having a disposable cartridge.
Figure 2:
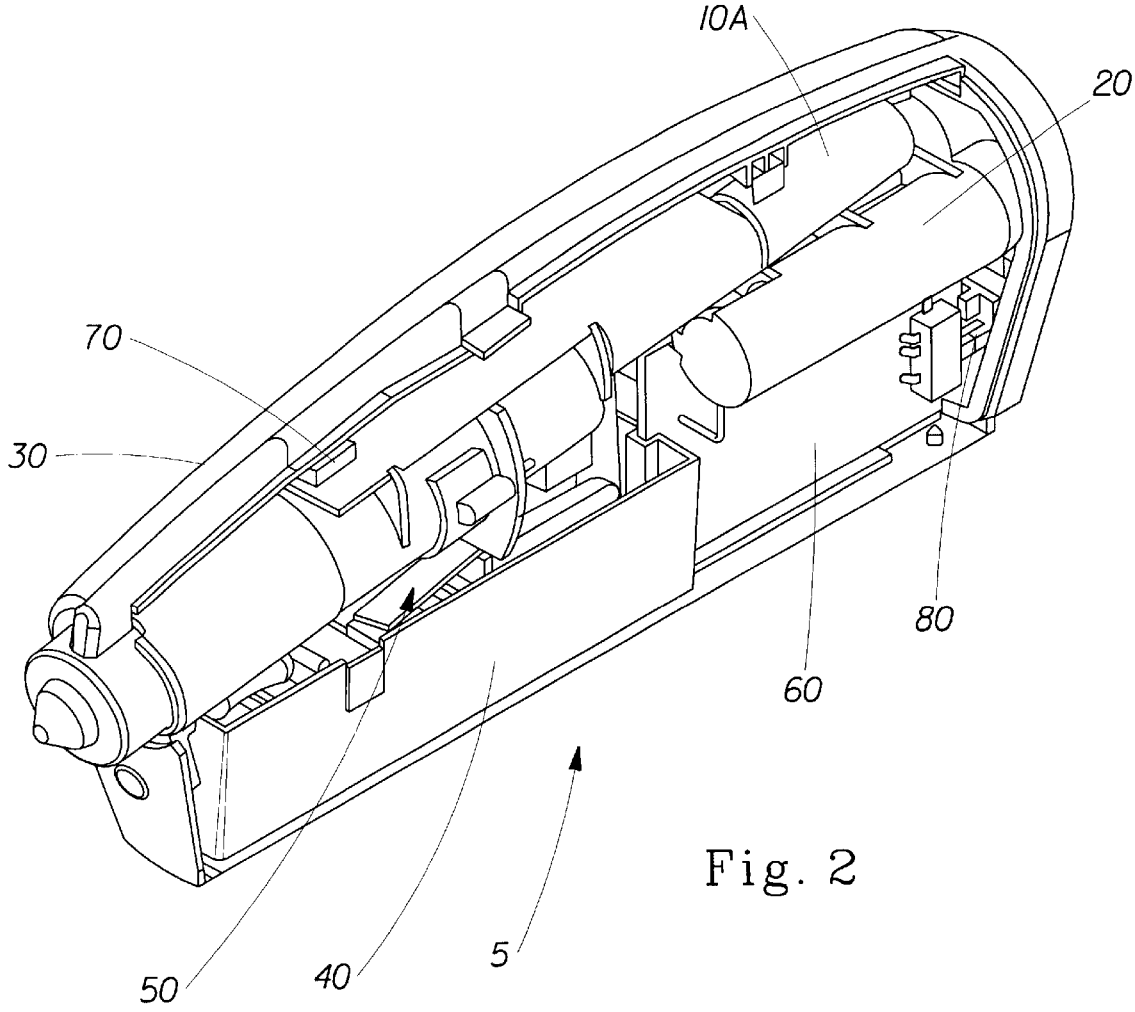
FIG. 2 is an assembled isometric view of the device within FIG. 1.

Referring to FIGS. 1 and 2, a hand-held, self-contained electrostatic spraying device 5 having a disposable cartridge 200 is shown. Disposable cartridge 200 may contain a variety of product, including but not limited to, cosmetics, skin creams, and skin lotions. The product in disposable cartridge 200 may be positively displaced (discussed infra) and powered by gearbox/motor component 10. Gearbox/motor component 10 may be fixed onto a left or first housing 30. The gearbox/motor component 10 can be affixed into place mechanically, adhesively, or by any other suitable technique. Gearbox/motor component 10 preferably comprises a precision motor 10*a* connected to a gearbox 10*b*. Power source 20 provides power to the device. An example of a suitable power source 20 includes, but is not limited to, two "AAA" type batteries. The power source 20 provides power to the device through the control circuit 60, the high voltage power supply 40, and then the high voltage contact 50, which contacts the disposable cartridge 200. High voltage power supply 40 is powered and controlled by control circuit 60 (discussed infra). Power-on switch 80 permits the user to cause an interruption between power source 20 and circuit control 60. Power-on switch 80 is designed such that voltage is supplied to the remainder of the circuit only when switch 80 is in the "ON" or closed position. Apply switch 70 permits the user to selectively activate motor 10*a*, thereby activating the delivery and spraying of the product. Gearbox/motor component 10 has a driver 90 fastened to a shaft (not shown in FIGS. 1 & 2, see FIG. 3) of gearbox 10*b*, for example, with a set screw (not shown). Driver 90 has a number of protruding fingers, for example, three, which can fit into the matching recesses on the back of actuator 240.

Figure 4:
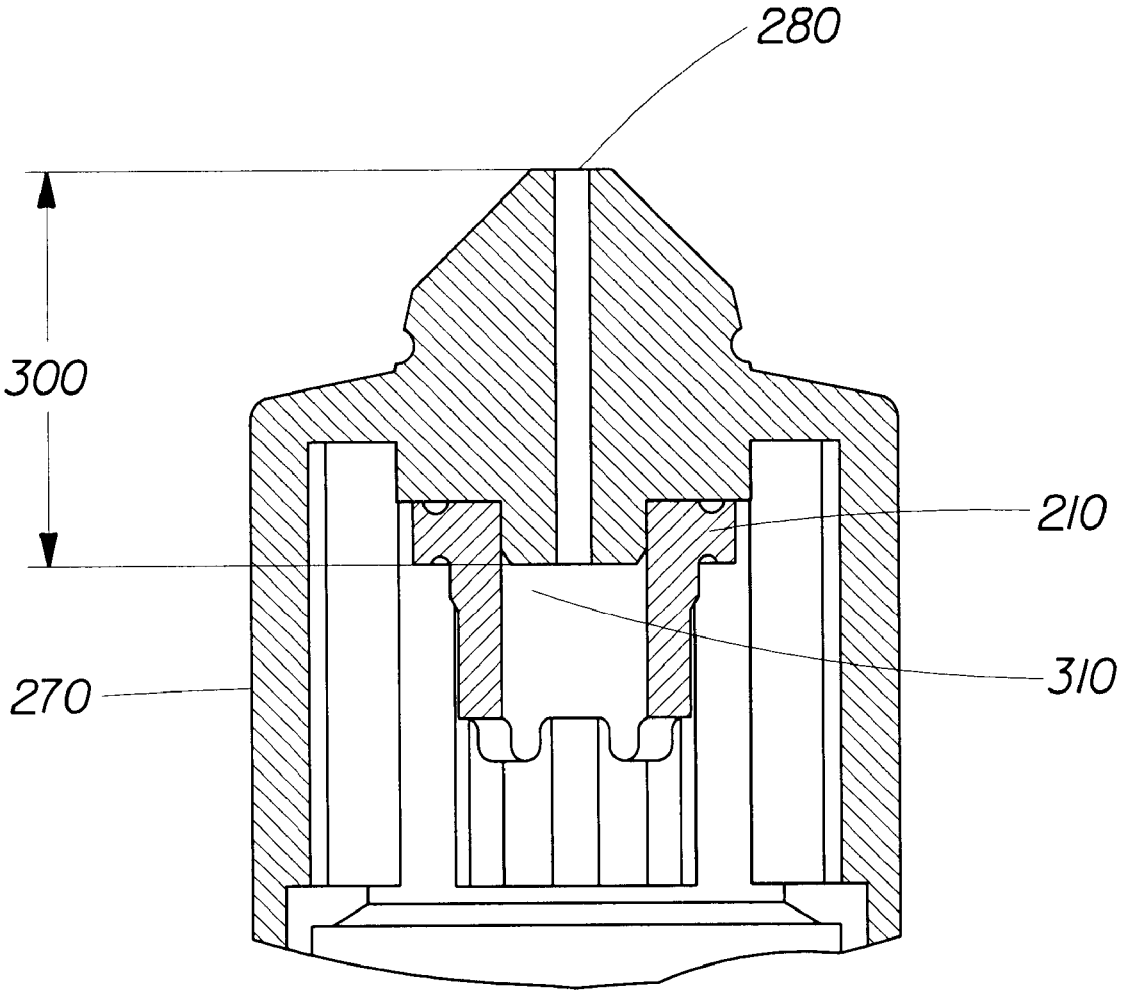
FIG. 4 is a cross-sectional view of the exiting portion of the device within FIG. 1.

Referring now to FIG. 4, a first aspect of this invention is directed at defining a spark gap 300 between the charging location 310 (e.g. a point within the open chamber of disposable cartridge 200 and also near high voltage electrode 210 (e.g., conductive shield) and the nozzle exit orifice 280 (e.g. point at which spray exits device 5). In order to minimize the risk of electrical shock in the form of a tactile discharge to the user, it is essential to maximize the distance between charging location 310 and nozzle exit orifice 280. It is currently believed that the prior art fails to teach this important relationship necessary to minimize the risk of electrical shock.

The preferred spacing between the charging location 310 and nozzle exit orifice 280 is governed by the following relationship:

$$V_o/d<100{,}000$$

Where:

$V_o$=output voltage of high voltage power supply 40 (v)

d=spark gap 300 (ie: linear distance between charging location 310 and nozzle exit orifice 280 (in))

As shown, it is desirable for this quotient ($V_o$/d) to be limited to preferably less than 100,000 V/in, more preferred is to limit this quotient to less than 70,000 V/in and most preferred is limiting this quotient to less than 50,000 V/in. Although not limited to, it is preferred that "$V_o$" range from 10,000 V to 20,000 and that "d" range from 0.1 in to 0.5 in. One skilled in the art could appreciate "$V_o$" and "d" values outside of these ranges so long as the above quotient was maintained.

Figure 3:
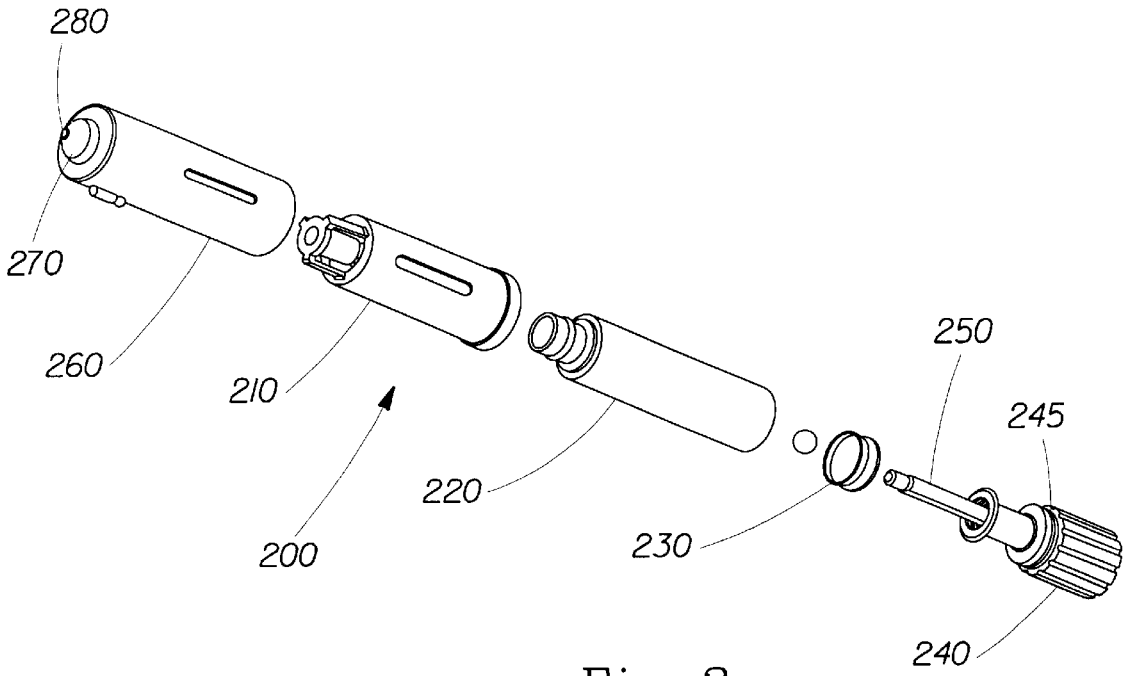
FIG. 3 is an exploded isometric view of the disposable cartridge within FIG. 1.

In a first embodiment of this invention, as exampled in FIGS. 3 and 4, disposable cartridge 200 has a conductive shield 210 which is positioned substantially around the outer perimeter of product reservoir 220. Conductive shield 210 may be constructed using conductive plastic (e.g. acrylonitrile butadiene styrene (ABS) filled with 10% carbon fibers), metal (e.g. aluminum) or any other suitable material. Conductive shield 210 may be formed as an integral part to cartridge insulator 260, such as through co-injection or two shot molding or any other manufacturing techniques. Alternatively, conductive shield 210 may be formed separately and then later connected to cartridge insulator 260 by any suitable technique, including but not limited to, force fitting. Actuator 240 is located at the non-discharge end of disposable cartridge 200. Actuator 240 may have internal threads (not shown) for passage of one end of a threaded shaft 250, and a snap bead 245 to snap into an open end of product reservoir 220. The opposite end of threaded shaft 250 can have a piston 230 which moves about. The threaded shaft 250 can thereby connect the piston 230 with actuator 240, such that piston 230 can slide along an inner surface of product reservoir 220, toward a nozzle 270, in response to the turning of actuator 240 by the gearbox/motor component 10. This movement of piston 230 can thus displace product from the product reservoir 220.

Electrical shock in the form of a tactile discharge to the user is likely to occur when no product is located within spark gap 300. Such a condition can exist, for example, when the user is using a disposable cartridge 200 for the first time (ie: before spark gap 300 is filled with product during a first product application). In this condition the above mentioned relationship is optimized (ie: minimize the quotient value) to prevent exceeding the break-down potential of air when a grounded object such as a the operator's finger is brought within immediate proximity of nozzle exit orifice 280.

For conductive fluids, electrical shock in the form of a tactile discharge to the user is also likely to occur when product fills spark gap 300. Such a condition exists, for example, when the user has already fully dispensed product from disposable cartridge 200 and thus the product pathway is full. In this condition the above mentioned relationship may need to be set at a quotient value less than 100,000 to prevent an electrical shock from occur. The actual reduced quotient value will be dependent upon the conductivity of the conductive fluid (ie: higher conductivity value of the fluid will require a lower quotient value).

It may also be appreciated by one skilled in the art that use of the above mentioned relationship must also be balanced with the need to maintain a certain voltage at nozzle exit orifice 280. That is, ideally, for electrostatic spraying devices where charging of the fluid occurs at a point remote from the nozzle (e.g. charging location 310), the ideal situation is for the charging of the fluid to occur at a maximum distance away from said nozzle exit orifice 280, thereby providing the highest degree of safety. However, there does exist a distance, that when charging occurs beyond said distance, the voltage drop within the volume of fluid between said charging location 310 and said nozzle exit orifice 280 is sufficiently large enough so as to effect the spray formation. Spray formation is affected because the voltage at nozzle exit orifice 280 is below that needed to form an optimal spray. Therefore, this distance must be optimized so as to not to significantly affect the spray quality.

Figure 10:
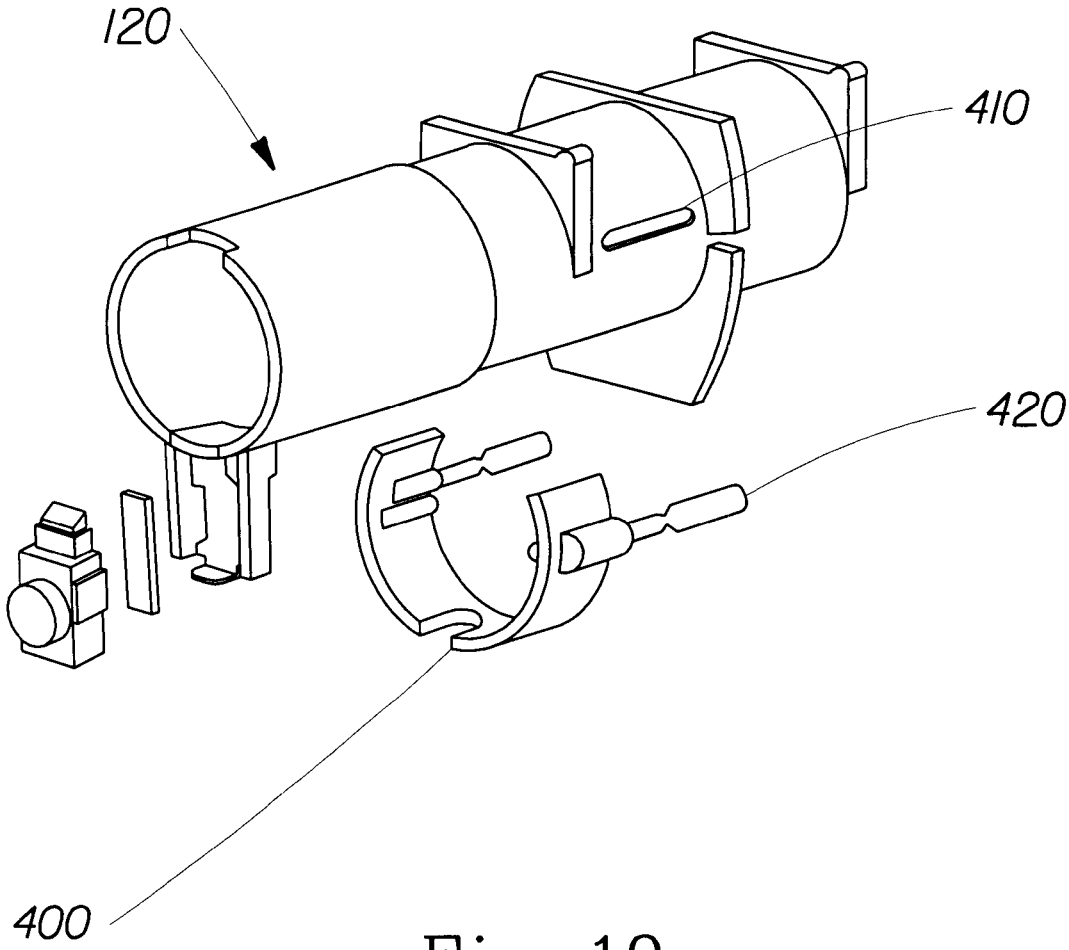
FIG. 10 is an exploded isometric view of the insert sleeve and accompanying parts within FIG. 1.

In yet another aspect of this invention, as exampled in FIGS. 1 and 10, a moveable electrode cover 400 is added. Electrode cover 400 is designed such that it substantially conceals high voltage contact 50 when disposable cartridge 200 is removed from device 5. Electrode cover 400 may be connected to insert sleeve 110. Insert sleeve 110 may house disposable cartridge 200. Electrode cover 400 is movably connected within slide channel 410. Bias springs 420 are positioned such that when no disposable cartridge 200 is within insert sleeve 110, bias springs 420 slide electrode cover 400 in a normally closed position that shields high voltage contact 50. When disposable cartridge 200 is placed within insert channel 110, electrode cover 400 is slid back in slide channel 410 to expose high voltage contact 50, such that it can then contact conductive shield 210 on disposable cartridge 200. Electrode cover 400 is of sufficient insulative quality so as to prevent electrical discharges from high voltage contact 50 through electrode cover 400 to a user.

A further embodiment of contact protection could also be in the form a high voltage contact in the device positioned such that said high voltage contact recesses when a cartridge is removed and makes proper contact with the cartridge electrode only when a cartridge is properly installed.

Figure 5:
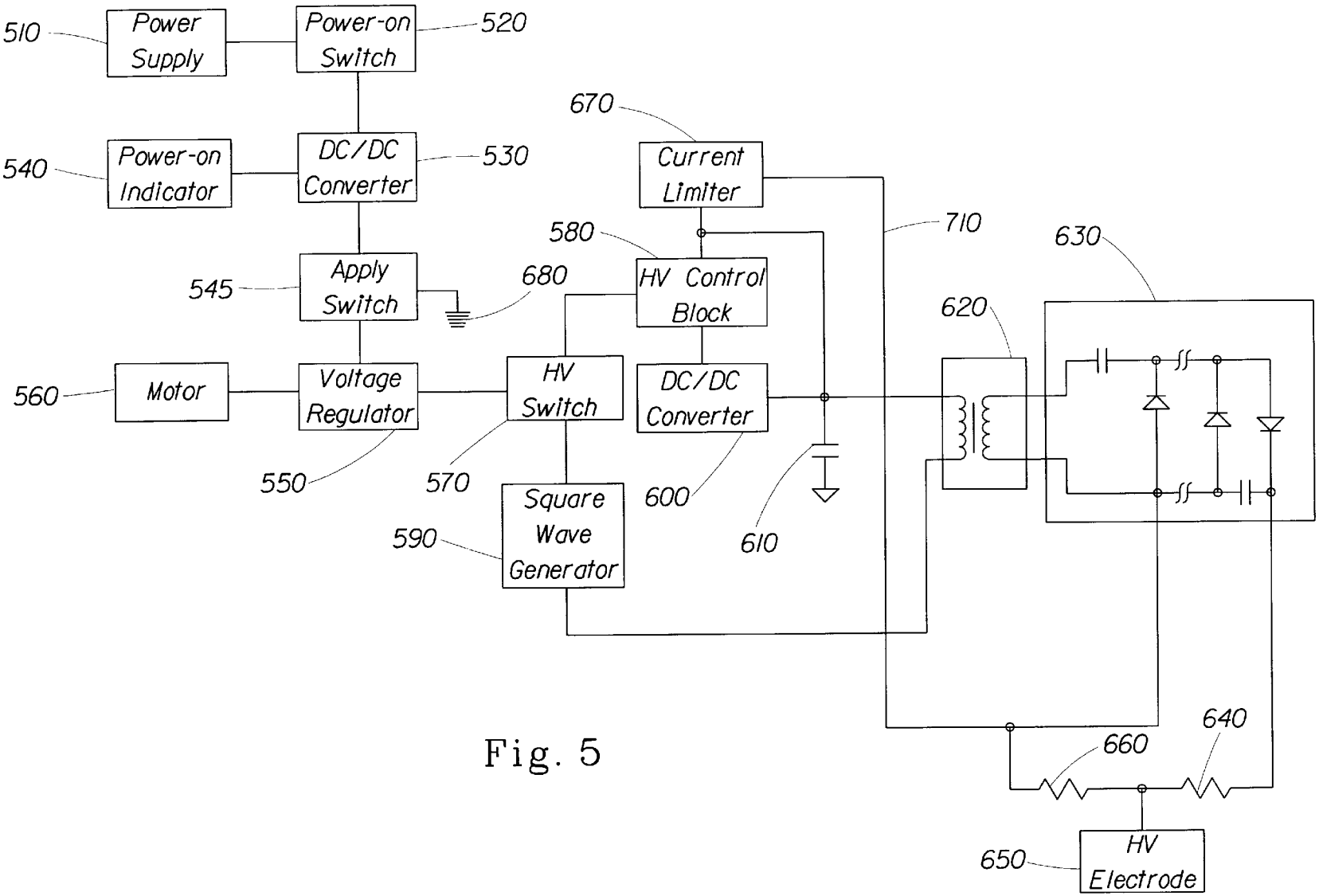
FIG. 5 is a schematic view of the electrical circuitry of one embodiment of an electrostatic spray device of the present invention.

FIG. 5 shows an electrical schematic of one embodiment of an electrostatic spraying device. The power source 510 shown can be a battery or other power source known in the art. For example, the power source can be one or more user replaceable battery such as two standard "AAA" batteries. Alternatively, the power source could be user-rechargeable cells, a non-user serviceable rechargeable power pack, or an external source (i.e. "line" supply). In at least one arrangement of the circuitry, power source 510 can be separated from the rest of the circuit by a power switch 520. The power switch 520 can extend the active life of a self-contained power source 510 such as a battery. The power switch 520 can also add a margin of safety to a line-voltage power supply by supplying power to the remainder of the circuit only when the power switch 520 is closed. In one embodiment, the power switch 520 can be a toggle switch that is able to maintain its setting until a later actuation. When switch 520 is turned to the "on" position, power is supplied to the DC/DC Converter 530.

The DC/DC Converter 530 receives an input voltage supply from power source 510, for example, a nominal 3.0 volt supply from two conventional "AAA" type batteries, and converts that to a higher voltage signal such as a 5.0 volt supply. The DC/DC Converter 530 can be, for example, a 3 to 5 V DC converter available from Linear Technology Corporation (Part number LT1317BCMS8-TR). The DC/DC Converter 30 can also be used to send a signal to indicator 540. This signal can be either a portion of the supply signal from power source 10, or a portion of the output signal, for example 5.0 volts. The indicator 540, for example, can be an LED that emits light in the orange range of the visible electromagnetic (EM) spectrum. As shown in FIG. 5, the indicator 540 can be arranged to emit visible light only when the power switch 520 is in the "on" position and sufficient voltage is supplied to the indicator 540 from DC/DC Converter 530. A user controlled apply switch 545 can be depressed or turned to the "on" position, depending on the type of switch employed, to complete the power supply circuit and provide power to the voltage regulator 550. The voltage regulator 550 can control the input voltage to a motor 560, if necessary. The nominal voltage output from the voltage regulator can be about 3.3 volts. The voltage regulator 550 can also send an output signal to the high voltage switch 570. The high voltage switch 570, for example, can be a transistor or diode element such as a transistor from NEC Corporation part number 2SA812.

The high voltage switch 570 supplies power to the remaining high voltage generation circuitry in response to a signal from the voltage regulator 550. The high voltage switch 570 sends a signal to both high voltage control block 580 and a signal generator such as square wave generator 590. The high voltage control block 580 compares a signal from storage capacitor 610 and current limiter 670 to an internally set reference voltage. Depending upon the value of the feedback signal from storage capacitor 110 and/or a signal from the current limiter 670, the high voltage control block 580 will send either an "ON" or an "OFF" signal to the DC/DC converter 600. The high voltage control block 580, for example, can be an op-amp such as Toshiba Corporation part number TC75W57FU.

The DC/DC converter 600 converts a lower input voltage to a higher output voltage. For example, the DC/DC converter 600 can convert a nominal input voltage of about 5.0 volts to a higher nominal output voltage of about 25.0 volts. The output from the DC/DC converter 600 charges the storage capacitor 610. The storage capacitor 610 provides an input voltage to the primary coil of the high voltage transformer 620. The frequency of the higher voltage output of DC/DC converter 600 is controlled, as described in more detail later, by a feedback loop to ensure that a substantially constant supply, such as about a 25.0 volts supply, is available to the high voltage transformer 620 from the storage capacitor 610. The DC/DC converter 600 can be, for example, a DC/DC Converter from Toshiba Corporation such as part number TC75W57FU. The high voltage switch 570 can also send an "ON" signal to the square wave generator 590, which is also connected to the primary coil of the high voltage transformer 620. This results in about a 25.0 volt peak to peak AC pulses being generated through the primary coil of the high voltage transformer 620. The square wave generator 590 can be, for example, an op-amp element from Toshiba Corporation such as part number TC75W57FU. The turn ratio of the high voltage transformer 620 can be, for example, about 100:1 such that an input voltage of about 25.0 volt at the primary coil would result in about a 2.5 kV (2500 volt) output voltage from the secondary coil. The output voltage from the high voltage transformer 620 can then be supplied to a voltage multiplier 630.

The voltage multiplier 630 rectifies the output signal from the high voltage transformer 620 and multiplies it to provide a higher voltage DC output voltage. If the output voltage of the high voltage transformer 620 is about a 2.5 kV AC signal, for example, the voltage multiplier 630 could rectify this signal and multiply it to provide a higher voltage DC output such as a 14.0 kV DC output voltage. In one embodiment, the voltage multiplier 630 can be a six stage Cockroft-Walton diode charge pump. A stage for a Cockroft-Walton diode charge pump is commonly defined as the combination of one capacitor and one diode within the circuit. One skilled in the art would recognize that the number of stages needed with a voltage multiplier is a function of the magnitude of the input AC voltage source and is dependent upon the required output voltage. In one embodiment, the high voltage transformer 620 and the voltage multiplier 630 can be encapsulated in a sealant such as a silicon sealant such as one available from Shin-Etsu Chemical Company, Ltd. as part number KE1204(A.B)TLV. By encapsulating the high voltage transformer 620 and the voltage multiplier 630 in the sealant, the electrical leakage and corona discharge from these high voltage components can be reduced to increase their efficiency.

A current limiting resistor 640 can be located between the output of high voltage multiplier 630 and the high voltage contact 650. The current limiting resistor 640 can be used to limit the current output from the high voltage multiplier 630 available to the high voltage contact 650. In one particular embodiment, the current limiting resistor 640 could be, for example, about 20 megaohms. One skilled in the art would recognize, however, that if a higher output current is desired, then a current limiting resistor with a lower resistance would be desired. Conversely, if a lower output current is desired, then a current limiting resistor with a higher resistance would be desired, The high voltage contact 650 can be made from a suitable metal or conductive plastic, such as acrylonitrile butadiene styrene (ABS) filled with 10% carbon fibers. A bleeder resistor 660, which is described in more detail below, can also be connected as shown in FIG. 5. The current limiter 670 is also connected to the output circuitry of the high voltage multiplier 630.

A ground contact 680 can also be provided to establish a common ground between the circuitry of the electrostatic spraying device and the user in order to reduce the risk of shocking the user. Further, in personal care applications, the ground contact 680 can also prevent charge from building-up on the skin of the user as the charged particles accumulate on the skin of the user. The ground contact 680 can be integrated into apply switch 545 and/or substantially adjacent to apply switch 545 such that the user cannot energize the motor 560 and the high voltage supply circuitry without simultaneously grounding themselves to the device. For example, the apply switch 545 can be made of metal and/or the ground contact can be a conductive contact or a grounding electrode can be located next to apply switch 545.

A further aspect of this invention allows the electrostatic spray device to reduce after-spray. After-spray is defined as when the electrostatic spraying device momentarily continues to spray product after power has been shut down to the high voltage power supply. Electrostatic spray devices with integral high voltage power supplies typically use capacitor-diode ladders to step-up output voltage from a primary high voltage transformer. One suitable capacitor-diode ladder is a Cockroft-Walton type diode charge pump. Capacitors are also used in electrostatic spray circuitry to improve the quality in the high voltage output and to reduce variations or noise. After the user turns off the device, the capacitors function as electrical storage elements and store the high voltage charge until the charge is dissipated such as through corona leakage to the atmosphere or a spark discharge to a point having a lower electrical potential (e.g., a shock to a user). This stored charge can continue to provide power to the high voltage contact 650 and may create enough of a potential difference between the product and nearby surfaces to allow for the product to spray after the power has been cut off to the high voltage power supply until the charge in the capacitors is sufficiently dissipated.

An after-spray condition is undesirable because the device continues to spray product after the user has turned off the device and the spray quality is inconsistent because the charge-to-mass ratio significantly varies. The desired charge-to-mass ratio is not maintained because there is not a consistent supply of high voltage current available to completely atomize the product into a spray. The charge stored within the device can partially atomize the product for a period of time while the charge dissipates to create an after-spray. Since the voltage supply to atomize the product is not constant, the charge-to-mass ratio of the resulting spray will vary resulting in the production of a spray that has varying spray quality. Further, the after-spray condition can produce a spray at an unintended time and/or location, such as continuing to spray after the user has placed the device in a purse or storage cabinet. This can create an unexpected and undesirable mess.

After-spray can be reduced or eliminated by rapidly discharging the capacitive elements after the power has been shut down to the high voltage power supply. In a first embodiment of this invention, a high voltage resistor, such as bleeder resistor 660 shown in FIG. 5, can be connected between the high voltage contact 650 and a point at a lower potential within the device. The bleeder resistor 660 can provide a path by which excess stored energy in the device, such as the energy stored in the capacitors within the voltage multiplier 630, can be dissipated in a relatively short period of time after the user has completed the spraying operation. thereby reducing the occurrence of after-spray. The bleeder resistor 660 should be selected to have a large enough resistance so that the impedance of bleeder resistor 660 will be significantly high when compared to the output current limiting resistor and the spray load so as to not dramatically effect the quality of spray or output of the high voltage generator during normal operation. If the value of bleeder resistor 660 is too low, bleeder resistor 660 will provide a path of lesser resistance than the resistance represented by the spraying operation. In this case bleeder resistor 160 will drain more current then desired during normal spraying operation. When the current passing through bleeder resistor 660 in normal spraying operation is too high, there will be insufficient current available for atomizing and charging the product. The bleeder resistor can further shorten the life of a portable power source such as a battery. The bleeder resistor 660 should, however, have a resistance low enough so as to allow for dissipation of stored energy in a relatively short period of time. The time needed to dissipate the stored energy of the device can be estimated by using the value of said capacitance multiplied by the value of bleeder resistor 660 to determine the value of an RC time constant. This relationship is given by:

$$\tau_A = C_D \times R_B$$

Where:

$\tau_A$=Time to drain approximately 63% of the stored capacitance from spraying device (sec)

$C_D$=Device capacitance (F)

$R_B$=Value of bleeder resistor (Ω)

This RC time constant, $\tau_A$, represents the approximate time required to dissipate approximately 63% of the charge of the storage device. The term $C_o$ represents a sum of the capacitance from conventional capacitor elements within the high voltage power supply circuit as well as capacitance of the product reservoir and other stray capacitance from within the device. Therefore, while applying this relationship, which has been adopted from conventional circuitry, it will be understood that in practice, $\tau_A$ represents a time in which greater than 63% of the stored charge is dissipated.

In some cases, the charge dissipated within $\tau_A$ is sufficient to reduce the charge within the device to a point where after-spray is reduced or eliminated. However, in some cases, the time $\tau_A$ may not be sufficient time to drain enough charge to reduce or completely eliminate after-spray. In these cases, the designer may desire to drain the entire stored charge from the within the device. In this case, it will be understood that the following relationship approximates a time, $\tau_B$, that will ensure complete dissipation of any stored charge. This relationship is given by:

$$\tau_B=5\times\tau_A=5\times C_D\times R_B$$

Where:

$\tau_B$=Time to drain 100% of the stored charge from the spraying device (sec)

$C_D$=Device capacitance (F)

$R_B$=Value of bleeder resistor (Ω)

One suitable range for a typical bleeder resistor is between about 1 MΩ and about 100 GΩ, another suitable range is between about 500 MΩ and about 50 GΩ, and yet another suitable range is between about 1 GΩ and about 20 GΩ. In one embodiment, for example, it may be desirable to completely drain the stored charge of the power supply in less than about 60 seconds, preferably in less than about 30 seconds, and most preferably in less than about 5 seconds. Using an example to illustrate, if it is desirable to dissipate at least about 63% of the stored charge of an electrostatic spraying device having a capacitance of about 500 pF (the device capacitance can be estimated by the sum of the capacitance in the high voltage power supply, the capacitance within the product reservoir and an estimate of the stray device capacitance) in about 5 seconds or less would require a bleeder resistor having a resistance of no more than about a 10 GΩ resistor.

$$R_B=5.0\text{ sec}/500\text{ pF}=10\ G\Omega$$

Depending upon the distribution of the capacitance (within voltage multiplier 630, the product reservoir capacitance and other stray capacitance) the 10 GΩ resistor, although dissipating at least 63% of the stored capacitance, may not in practice always eliminate the after-spray condition. Therefore, to ensure that 100% of the device capacitance is drained in the same 5 second interval the resistance of the bleeder resistor 660 would need to be no more than about 2 GΩ.

$$R_B=(5.0\text{ sec}/500\text{ pF})/5=2\ G\Omega$$

In at least one embodiment, for example, bleeder resistor 660 could be a high voltage resistor having a resistance of about 10 GΩ such as the high voltage resistor available from Nihon Hydrajinn Company available under the part number LM20S-M 10G.

Figure 6:
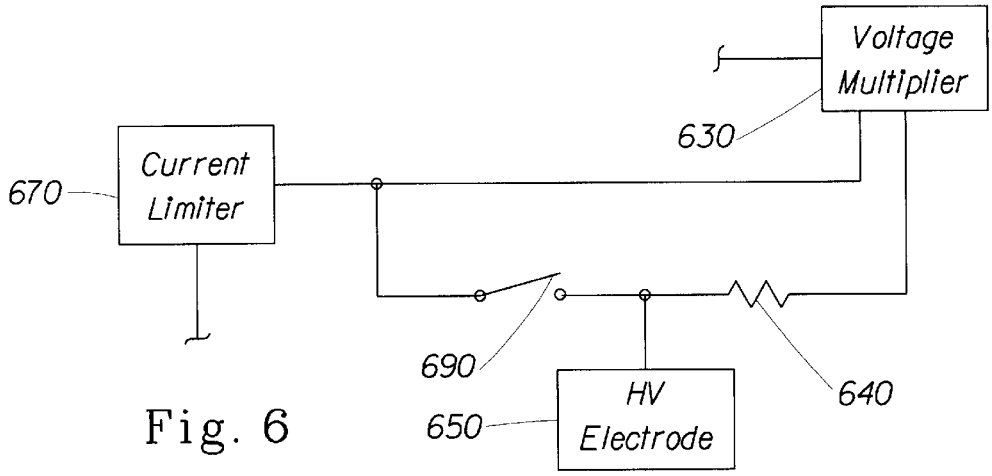
FIG. 6 is a schematic view of a portion the electrical circuitry of another embodiment of an electrostatic spray device of the present invention.

In another embodiment of this invention shown in FIG. 6, a mechanical switch 690 can be provided to reduce the effects of after-spray. The high voltage mechanical switch 690 performs a similar function as bleeder resistor 660 with the exception that the high voltage mechanical switch 690 is not an active circuit element during normal spraying operation. Rather, the mechanical switch is arranged so that during normal spraying operation the switch is in the open position and is not drawing any current. However, when the user intends to cease the spraying operation and de-energizes the device, the high voltage mechanical switch 690 is shifted from the open position to the closed position so that a conductive path exists between the high voltage contact 650 directly to the grounded side of the device circuit, thereby providing a nearly instantaneous release for any stored charge within the device. One advantage of the high voltage mechanical switch 690 design is that the conductive path to ground does not need to include a resistor and allows for a faster discharge rate. Further, the conductive path is only available when the device is de-energized, i.e., in the off position, and does not interfere with normal spraying operation by draining energy from the high voltage contact 650 and will not require the high voltage generating circuitry to generate excess power to compensate for power losses associated with the bleeder resistor 660.

Figure 7:
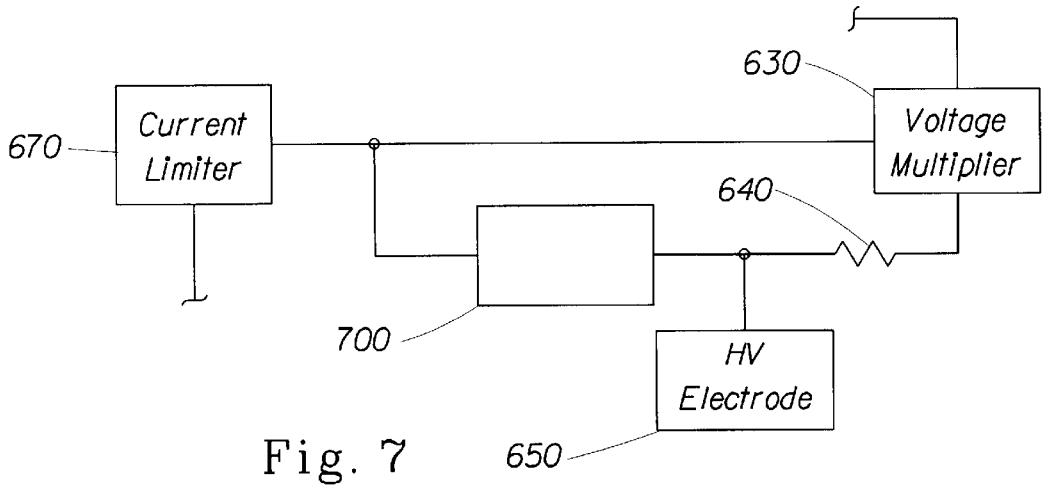
FIG. 7 is a schematic view of a portion the electrical circuitry of another embodiment of an electrostatic spray device of the present invention.

In yet another embodiment shown in FIG. 7, the device comprises a high voltage electrical switch 700, such as a transistor, in place of bleeder resistor 660 shown in FIG. 5. During normal spraying operation, the switch is in the open position and the conductive path to a point of lower potential of the circuitry is not active. However, upon the operator de-energizing the device, the switch is closed and the conductive path to a point of the circuit having a lower potential is then available to drain the stored charge in the device. Again, the high voltage electrical switch 700 can provide a lower resistance than the bleeder resistor 660 and, thus, allows for a quicker discharge of the stored charge in the device. The high voltage electrical switch 700 further provides a conductive path that is only available when the device is de-energized, i.e., in the off position, and does not interfere with normal spraying operation by draining energy from the high voltage contact 650 and will not require the high voltage generating circuitry to generate excess power to compensate for power losses associated with the bleeder resistor 660.

Figure 8:
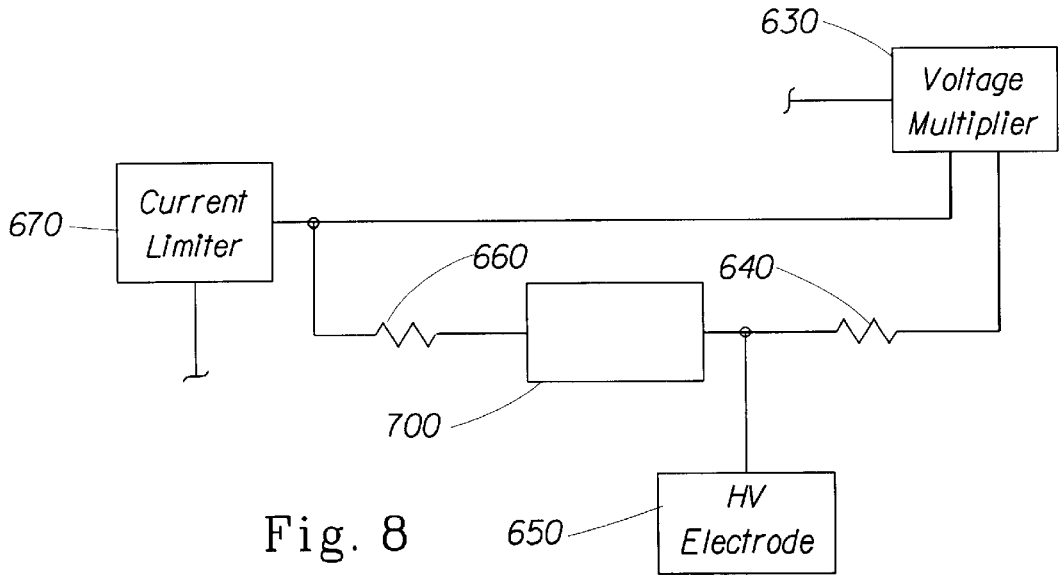
FIG. 8 is a schematic view of a portion the electrical circuitry of another embodiment of an electrostatic spray device of the present invention.
Figure 9:
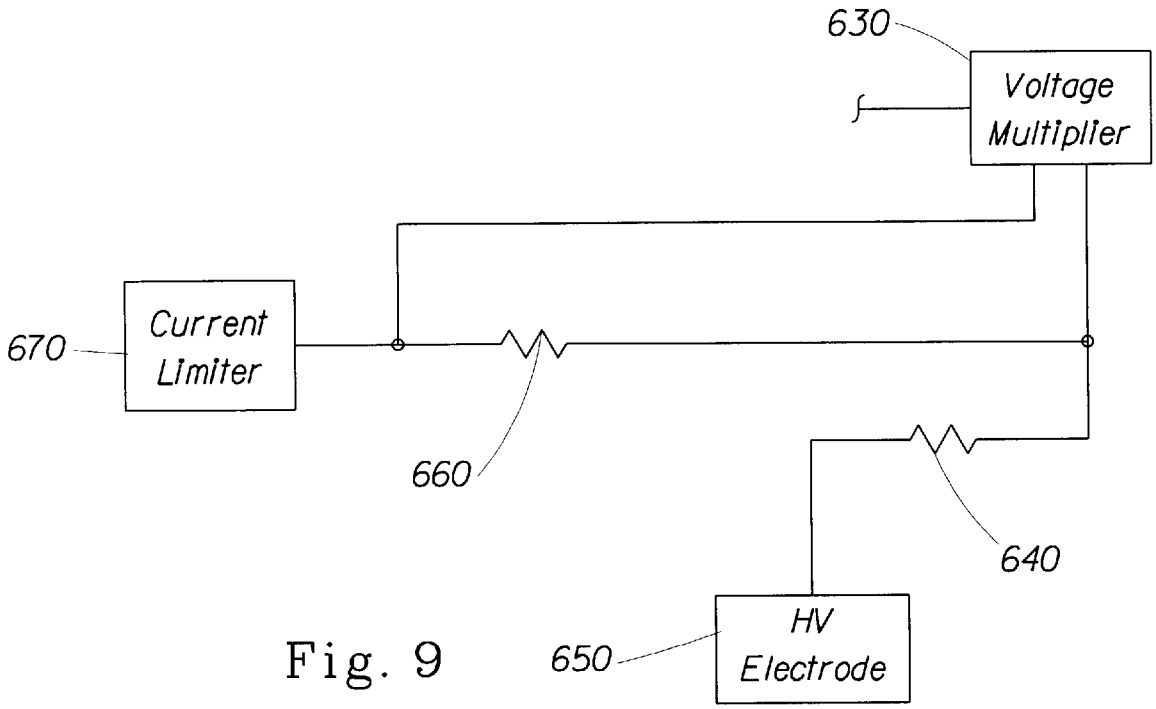
FIG. 9 is a schematic view of a portion the electrical circuitry of another embodiment of an electrostatic spray device of the present invention.

One skilled in the art may appreciate that either of the arrangements shown in FIG. 6 or FIG. 7 may also include a bleeder resistor 660 such as shown in FIG. 8. In some cases it may be desirable to control the rate at which the stored capacitance is discharged. In such a case, the bleeder resistor 660 can be connected to either the high voltage mechanical switch 690 or the high voltage electrical switch 700 as shown in FIG. 8. Further, one skilled in the art will also recognize that a bleeder resistor and/or mechanical or electrical switches may be arranged in other configurations. For example, FIG. 9 shows one alternative configuration in which the bleeder resistor 660 is connected between the voltage multiplier 630 and the current limiting resistor 670 and a point at a lower potential.

Yet another aspect of this invention, as exampled in FIG. 5, is providing current limiting control circuitry to control the output current from the high voltage supply means. Current limiter 570 monitors the output current at the first stage of voltage multiplier 530. Current limiter can be an op-amp element of the type, for example, from Toshiba Corporation, part number TC75W57FU. Current limiter, as shown, tracks the current in ground return loop of voltage multiplier 630. When the output current exceeds a predetermined value, said predetermined value set using a reference voltage to the op-amp, current limiter 670 sends an override signal to high voltage control block 580. The override signal sent to high voltage control block 580 overrides the signal from ground return loop 630 and changes the output from to DC/DC converter 600 from "ON" to "OFF", thereby preventing a further increase in current through voltage multiplier 630. When the current in feedback loop 710 drops below the predetermined setpoint, the signal from current limiter 670 to high voltage control block 680 changes, thereby allowing high voltage control block 580 to resume monitoring feedback loop 710 and sending an "ON" signal to DC/DC converter 600. The need for current limiter 670 is very important, for example, when using a circuit with an adjustable output power supply, As described, high voltage control block 580 is designed to monitor the voltage output of the device, and when needed (e.g. in high humidity conditions) increases the current output of voltage multiplier 630 to maintain the desired voltage at high voltage contact 650. Without current limiter 670,the current output of voltage multiplier 630, in cases of an extremely loaded condition (e.g. high humidity) would increase to levels which are unsafe and thereby increasing the shock potential of a tactile discharge to a user.

Having shown and described the preferred embodiments of the present invention, further adaptions of the present invention as described herein can be accomplished by appropriate modifications by one of ordinary skill in the art without departing from the scope of the present invention. Several of these potential modifications and alternatives have been mentioned, and others will be apparent to those skilled in the art. For example, while exemplary embodiments of the present invention have been discussed for illustrative purposes, it should be understood that the elements described will be constantly updated and improved by technological advances. Accordingly, the scope of the present invention should be considered in terms of the following claims and is understood not to be limited to the details of structure, operation or process steps as shown and described in the specification and drawings.

Incorporation by Reference

Relevant electrostatic spray devices and cartridges are described in the following commonly-assigned, concurrently-filed U.S. Patent Applications, and hereby incorporated by reference:

"Electrostatic Spray Device", which is assigned Ser. No. 09/759,552 Attorney Docket No. 8394.

"Electrostatic Spray Device", which is assigned Ser. No. 09/759,551 Attorney Docket No. 8395.

"Disposable Cartridge For Electrostatic Spray Device", which is assigned Attorney Docket No. 8397.

What is claimed is:

1. An electrostatic spraying device being configured and disposed to electrostatically charge and dispense a product from a supply to a point of dispersal, wherein said device comprises:

a reservoir configured to contain the supply of product;

a nozzle to disperse the product, said nozzle being disposed at the point of dispersal; said nozzle having an exit orifice;

a channel disposed between said reservoir and said nozzle, wherein said channel permits the electrostatic charging of the product upon said product moving within said channel;

a mechanism to move the product from said reservoir to said nozzle;

a power source to supply an electrical charge;

a high voltage power supply, said high voltage power supply being electrically connected to said power source;

a high voltage contact; said high voltage contact being electrically connected to said high voltage power supply; and a high voltage electrode, said high voltage electrode being electrically connected to said high voltage power supply, a portion of said high voltage electrode being disposed between said reservoir and said nozzle, said high voltage electrode electrostatically charges the product within said channel at a charging location;

wherein the distance between the charging location and said nozzle exit orifice is governed by the following relationship:

$$V_o/d<100{,}000$$

wherein:

$V_o$=an output voltage of said high voltage power supply (V)

d=linear distance between the charging location and said nozzle exit orifice (in.).

2. The electrostatic spraying device of claim 1, wherein the relationship $V_o/d$ is preferably less than 70,000.

3. The electrostatic spraying device of claim 1, wherein the relationship $V_o/d$ is more preferably less than 50,000.

4. The electrostatic spraying device of claim 1, wherein "$V_o$" preferably ranges from 10,000 volts to 20,000 volts.

5. The electrostatic spraying device of claim 1, wherein "d" preferably ranges from 0.1 in to 0.5 in.

6. An electrostatic spraying device being configured and disposed to electrostatically charge and dispense a product from a supply to a point of dispersal, wherein said device comprises:

a reservoir configured to contain the supply of product;

a nozzle to disperse the product, said nozzle being disposed at the point of dispersal; said nozzle having an exit orifice;

a channel disposed between said reservoir and said nozzle, wherein said channel permits the electrostatic charging of the product upon said product moving within said channel;

a mechanism to move the product from said reservoir to said nozzle;

a power source to supply an electrical charge;

a high voltage power supply, said high voltage power supply being electrically connected to said power source;

a high voltage contact; said high voltage contact being electrically connected to said high voltage power supply;

a high voltage electrode, said high voltage electrode being electrically connected to said high voltage power supply, a portion of said high voltage electrode being disposed between said reservoir and said nozzle, said high voltage electrode electrostatically charges the product within said channel at a charging location; and a movable electrode cover; said electrode cover substantially conceals said high voltage contact when said disposable cartridge is removed from said device.

7. The electrostatic spraying device of claim 6, wherein said electrode cover being connected and movable within an insert sleeve.

8. The electrostatic spraying device of claim 7, wherein at least one bias spring is used to position said electrode cover in a closed position when said disposable cartridge is removed from said device.

9. An electrostatic spraying device being configured and disposed to electrostatically charge and dispense a product from a supply to a point of dispersal, wherein said device comprises:

a reservoir configured to contain the supply of product;

a nozzle to disperse the product, said nozzle being disposed at the point of dispersal; said nozzle having an exit orifice;

a channel disposed between said reservoir and said nozzle, wherein said channel permits the electrostatic charging of the product upon said product moving within said channel;

a mechanism to move the product from said reservoir to said nozzle;

a power source to supply an electrical charge; a high voltage power supply, said high voltage power supply being electrically connected to said power source;

a high voltage contact; said high voltage contact being electrically connected to said high voltage power supply; and a high voltage electrode, said high voltage electrode being electrically connected to said high voltage power supply, a portion of said high voltage electrode being disposed between said reservoir and said nozzle, said high voltage electrode electrostatically charges the product within said channel at a charging location, wherein said high voltage contact recesses when said disposable cartridge is removed from said device and said high voltage contact resurfaces when said disposable cartridge is inserted into said device.

* * * * *